US006807705B2

(12) United States Patent
Piombini

(10) Patent No.: US 6,807,705 B2
(45) Date of Patent: Oct. 26, 2004

(54) POLISHING PAD AND SYSTEM

(75) Inventor: Robert Piombini, Burlington (CA)

(73) Assignee: Saint-Gobain Abrasive Technology Company, Worcester, MA (US)

( * ) Notice: Subject to any disclaimer, the term of this patent is extended or adjusted under 35 U.S.C. 154(b) by 281 days.

(21) Appl. No.: 10/099,166

(22) Filed: Mar. 15, 2002

(65) Prior Publication Data

US 2002/0144372 A1 Oct. 10, 2002

Related U.S. Application Data

(63) Continuation-in-part of application No. 09/826,343, filed on Apr. 4, 2001, now Pat. No. 6,523,215.

(51) Int. Cl.[7] ..... B05C 17/10
(52) U.S. Cl. ..... 15/230.1; 15/230
(58) Field of Search ..... 15/230, 230.1, 15/230.12, 230.16, 230.17, 230.18, 244.1, 244.4; 451/357–359, 259, 270

(56) References Cited

U.S. PATENT DOCUMENTS

| | | | | |
|---|---|---|---|---|
| 1,777,915 A | * | 10/1930 | Douglas | 15/230.17 |
| 2,319,873 A | | 5/1943 | Linz | |
| 3,008,168 A | | 11/1961 | Doyle | |
| 3,317,944 A | | 5/1967 | Napier et al. | |
| 3,703,739 A | * | 11/1972 | Young et al. | 15/230.17 |
| 3,707,012 A | | 12/1972 | Lane | |
| 3,990,124 A | * | 11/1976 | MacKay et al. | 15/230.12 |
| 4,403,367 A | | 9/1983 | Brown et al. | |
| 4,502,174 A | * | 3/1985 | Rones | 15/98 |
| 4,962,562 A | * | 10/1990 | Englund et al. | 15/230.16 |
| 5,007,128 A | * | 4/1991 | Englund et al. | 15/230.16 |
| 5,185,964 A | | 2/1993 | Englund et al. | |
| 5,311,634 A | * | 5/1994 | Andros | 15/97.1 |
| 5,396,737 A | * | 3/1995 | Englund et al. | 451/28 |
| 5,461,750 A | * | 10/1995 | Kaiser | 15/230 |
| 5,806,135 A | | 9/1998 | Earle | |
| 5,822,826 A | | 10/1998 | Parker | |
| 5,962,120 A | | 10/1999 | Keipert | |
| 6,523,215 B2 | * | 2/2003 | Piombini | 15/230.1 |

FOREIGN PATENT DOCUMENTS

| | | | |
|---|---|---|---|
| DE | 811671 | | 8/1951 |
| EP | 0 459 699 | * | 5/1991 |

* cited by examiner

*Primary Examiner*—Terrence R. Till
*Assistant Examiner*—Laura C Cole
(74) *Attorney, Agent, or Firm*—Joseph P. Sullivan

(57) ABSTRACT

The invention provides a double sided waffle-surfaced foam polishing pad and a polishing system with which it can be used. The double sided feature allows great versatility in the type of polishing that can be accomplished using the same pad.

20 Claims, 2 Drawing Sheets

POLISHING PAD AND SYSTEM

This is a Continuation-In-Part of application Ser. No. 09/826,343, filed on Apr. 4, 2001 and is entitled Polishing Pad and System, now U.S. Pat. No. 6,523,215.

BACKGROUND OF THE INVENTION

This invention relates to pads used for polishing finished surfaces particularly where these have been painted and it is desired to remove imperfections from such surfaces.

It is well known that pads for such applications should have relatively high level of conformability, that is to say, they should be readily deformable to conform to the surface being polished to avoid excessive pressure being applied to one spot by comparison with an adjacent spot. For ease of application foam pads are typically adopted either as a backing for a conventional flexible sheet of a coated abrasive or as a foam pad with abrasive particles bonded directly to the surface of the foam or applied as a slurry between the pad and the surface.

The surface of the pad which contacts the workpiece can be planar or contoured with the latter being preferred where it may be desired to polish lightly with only a portion of the surface in contact with the workpiece or, more vigorously, compressed so essentially all the foam surface contacts the workpiece. Typical foams of this description are described in U.S. Pat. Nos. 4,962,562; 5,007,128 and 5,396,737.

Such foams however lack an element of versatility in that they have a uniform composition and density such that only a single type of polishing can be performed and the pad needs to be changed if something different is required.

The present invention provides a system that is very adaptable and versatile while remaining extremely simple to use.

DESCRIPTION OF THE INVENTION

The present invention provides a resiliently compressible foam polishing pad comprising first and second opposed major working surfaces, each having a plurality of spaced depressions with the general shape of truncated hollow cones, (optionally with the truncated ends, which form the bases of the depressions, rounded), separated by truncated cones wherein the tops of the truncated cones, which also may optionally be rounded, all lie in the same plane and form the working surface. The truncated depressions and the cones described above are usually of the same dimensions such that notionally a cone would fit snugly within a depression but this is not an essential feature of the invention.

Generally the depressions in each major working surface are all of the same depth but it is often advantageous if the depressions have different depths even on the same working surface, such that upon increasing the compressive force upon the foam, the foam is flattened to increase the area of the surface in polishing contact with a workpiece, that is, the effective working surface, in two or more stages.

Portions of the foam between the depressions are described as "truncated cones" but it is understood that, where the depressions are not uniform in size or are relatively widely spaced, the shapes of the structures between the depressions may not conform exactly to truncated cones and might even be interconnected with other adjacent structures. It is however understood that such structures are not excluded from the intended scope of the claimed invention.

While it is often preferred that the first and second working surfaces have the same working surface design this is by no means the only permissible structure. If it is desired to take advantage of the provision of two working surfaces on the same pad, the second working surface can have structures giving a different range of polishing options. This can be achieved by varying the separation between the depressions or their depth but more often the differentiation is achieved by using a foam of different compressibility with, optionally, the surface structure variations discussed above in addition.

The foam pad of the invention is of necessity compressible and therefore is preferably made from a polymer that can be foamed to make a resilient material that can be compressed and recover substantially its original dimensions after removal of the compressive forces. The polymer is preferably a thermoplastic or rubbery polymer such as for example a polyolefin, a plasticized polyvinyl halide, a polydiene or a polyurethane. For ease of manufacture and economy the preferred polymer is a polyurethane and most preferably an open-celled polyurethane which can be foamed with great control to produce a foam with a precisely controlled density.

The provision of a foam pad with two working surfaces can be achieved using appropriate molding techniques but more frequently it is achieved by laminating different foams together. This presents the opportunity to produce a pad in which each working surface is different in terms of structure, and/or, more preferably, foam density. The two pads can be laminated using an intermediate layer that can be simply an adhesive layer but more preferably is a rubbery polymeric layer which, while being flexible and possibly even foamed, is stiff enough to confer some increased dimensional stability on the pad. A suitable polymer for adhering such foam components together so as to form the pad is a polybutylene rubber. The relative physical stiffness of the intermediate layer becomes particularly important when the foam is to be used with a mechanized polisher which will require that the foam pad be retained within a holder of some sort.

The invention therefore also comprises a polishing system adapted for use in conjunction with an orbital polisher which comprises:

a) a resiliently compressible foam polishing pad in the form of a disc comprising first and second opposed major working surfaces, each having a plurality of spaced depressions with the general shape of truncated hollow cones, (optionally with the truncated ends, which form the bases of the depressions, rounded), separated by truncated cones wherein the tops of the truncated cones, which also may optionally be rounded, all lie in the same plane and form the working surface;

b) a backup pad with which the foam polishing pad is retained in contact with one working surface projecting beyond the backup pad and the second working surface in contact with the backup pad; and c) retaining means for retaining one surface of the polishing pad in releasable contact with the backup pad.

The preferred form of retaining means restrain the pad against movement relative to the backup pad while in use in addition to providing a means by which the foam pad can be attached to an orbital sander for example by an axially located mandrel adapted to fit in the arbor of an orbital sander.

When the backup pad has the form of a retaining within which the polishing pad is partially retained during use, the retaining means can take the form of pins or protrusions adapted to fit within corresponding holes or depressions in the polishing pad. They can also take the form of clips adapted to bear against the circumference of the pad or in depressions cut into the circumference of the pad intermediate between the working surfaces. Such depressions are conveniently in the portion of the circumference midway between the first and second working surfaces. When the pad if formed by laminating two pads using a harder polymeric layer, the depressions are conveniently formed in this layer so as to provide a cooperating surface for the clips or other retaining means that is less readily deformed than a foam providing the first or second working surface.

In the case in which the backup pad is in the form of a disc contacting one surface of the polishing pad, the retaining means can comprise an axially located member adapted to pass through the polishing pad and cooperate with an attachment means which bears upon the polishing pad in an axial depression in the working surface of the polishing pad. The axially located member can be for example an internally threaded tube or an externally threaded rod cooperating with a threaded member bearing against the surface of the polishing pad to retain it in position on the backup pad. It could also have the form of a grooved rod adapted to receive a clamping device such as a C-clip or a rod with a hole with a washer and cooperating cotter pin. Sometimes quick-release fittings such as one in which a spring-seated projection such as a ball bearing cooperates with a groove so secure releasable attachment. Other embodiments well-known in the art comprise a radial projection cooperating with an L-shaped slot with engagement secured by insertion of the radial projection on the retaining means, into the slot followed by an axial part-rotation of the retaining means to locate the projection in the angled portion of the slot. Alternative attachment mechanisms well know in the art can be substituted for those described above.

The backup pad is preferably provided with a plurality of projections engaging with the surface of the polishing pad such that, in use, the polishing pad is restrained against rotational movement relative to the backup pad.

It is often preferred to give the foam pad ventilation channels connecting first and second working surfaces to aid in cooling the surfaces during polishing. Such channels are advantageously provided also in the body of the retaining cup such that air can circulate around the pad while it is in use.

DESCRIPTION OF PREFERRED EMBODIMENTS

The invention is now described in terms of the embodiments illustrated in FIGS. 1–4. It is understood that other embodiments of the invention which differ from that illustrated are possible without departing from the essence of the invention.

Figure 1:
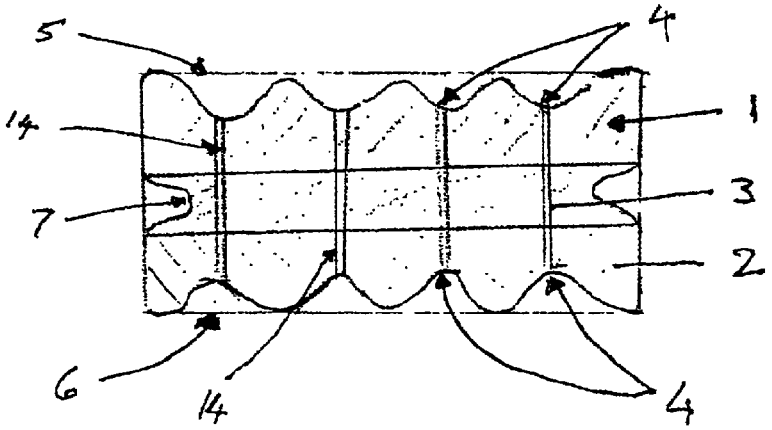
FIG. 1 shows a cross-section of a two sided foam polishing pad according to the invention.

In FIG. 1 of the drawings, disc-shaped foam pads, 1 and 2, are laminated together using a rubbery polymer layer, 3, having recesses, 7, at spaced intervals around the circumference. The layers 1 and 2 of the combined pad are each provided with a plurality of recesses, 4, in working surfaces 5 and 6 respectively. Foam pad ventilation channels 14 connects first and second working surfaces to aid in cooling the surfaces during polishing.

Figure 3:
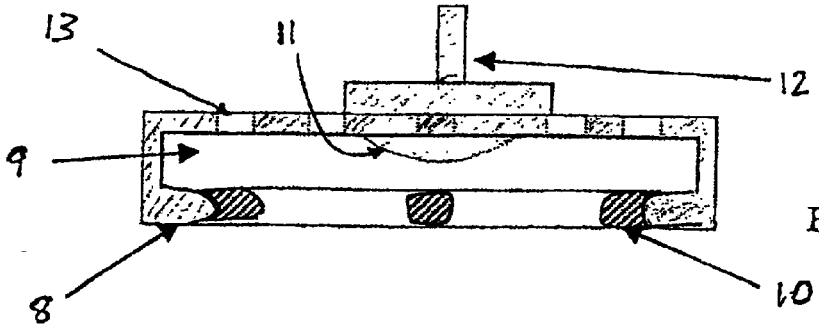
FIG. 3 shows the retaining cup of FIG. 2 in vertical cross-section along line A–A'.
Figure 2:
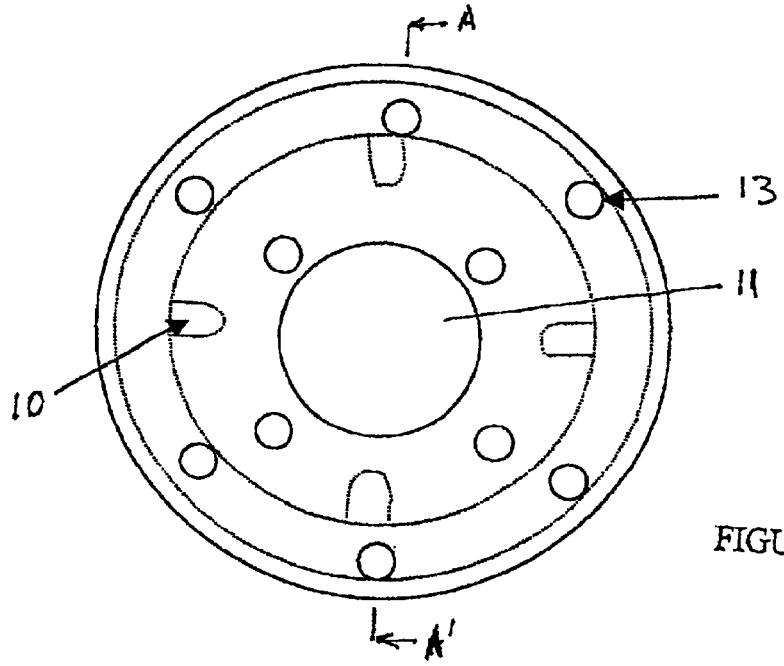
FIG. 2 shows a plan view of the open side of a backup pad in the form of a retaining cup.

The foam pad of FIG. 1 is used in conjunction with a backup pad and in FIGS. 2 and 3 this has the form of a cup-shaped holder having a shallow cylindrical cup-shaped holder having a small lip, 8 projecting radially inwards. This cup encloses a space, 9, in which one half of the foam pad illustrated in FIG. 1 may be accommodated. Four resilient clips, 10, project radially inwardly from the lip of the cup. When a foam pad is accommodated within the holder these clips project into the recesses, 7, in the rubbery polymer layer to prevent rotation relative to the cup when the pad is in use. The inside surface of the cup is provided with an axial shallow boss, 11, which bears against the working surface of the pad that is not in use so as to limit the amount of deformation of the pad into the holder that can occur when the pad is in use. The holder is adapted for mounting on an orbital polishing machine by a mandrel, 12, projecting from the bottom of the holder. Ventilation holes, 13 are provided at intervals around the cup to permit air circulation when the pad is in use.

Figure 4:
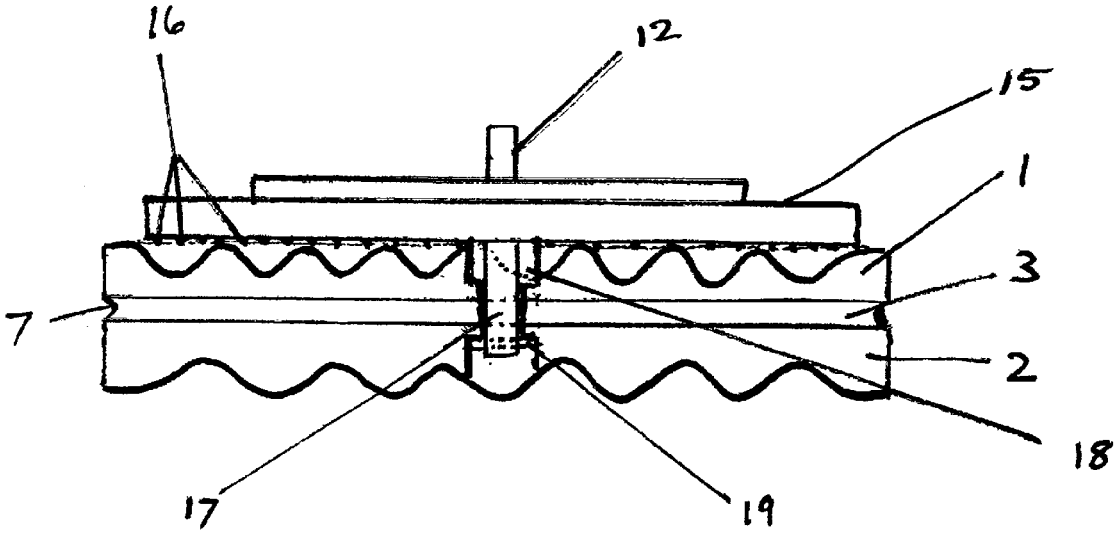
FIG. 4 shows a different form of backup pad with attached polishing pad in cross section.

In the alternative embodiment shown in FIG. 4 the backup pad has the form of a plate, 15, having a mandrel, 12, by which the backup plate may be attached to an orbital sander or polisher. The surface of the backup plate in contact with the polishing pad is provided with projections, 16, designed to contact the polishing pad surface and provide sufficient resistance to inhibit rotation relative to the backup pad. The backup pad also has an axially located extension rod, 17, which passes through a cooperating hole, 18, in the polishing pad. The surface of the polishing pad is provided with a recessed axial area, 20, such that a retaining means, 19, which cooperates with the extension rod, 17, to hold the polishing pad in position on the backup pad, fits into the recess. The recess is deep enough that neither the rod nor the retaining means project above the surface of the polishing pad even at the point of maximum compression during use. In the illustrated embodiment the rod has an external thread and the retaining means has the form of a flange nut that fits over the rod.

To use the pad with an orbital polisher, the pad is placed in the holder with one working surface in contact with the boss, 11, at the base of the holder and with the clips, 10, accommodated within the recesses, 7 in the intermediate rubbery layer, 3, of the pad. Thus the second working surface projects from the holder such that the portion of the pad between the intermediate layer and the working surface can be fully compressed to make the bottoms of the depressions part of the working surface without contacting the holder with the workpiece.

When it is desired to work with a foam having the characteristics of the foam providing the second working surface, the pad is simply removed from the holder and reversed.

As will be seen the present invention provides a highly versatile polishing pad capable of working under a number of different polishing conditions by a simple manipulation of the pad and backup pad.

We claim:

1. A resiliently compressible foam polishing pad comprising first and second opposed major working surfaces, each having a plurality of spaced depressions with the general shape of truncated hollow cones, separated by truncated cones wherein the tops of the truncated cones all lie in the same plane and form the working surface and having ventilation channels connecting first and second major working surfaces.

2. A foam polishing pad according to claim 1 in which the truncated ends forming the bases of the depressions and the tops of the truncated cones forming part of the working surface are rounded.

3. A foam polishing pad according to claim 1 in which the foam providing the first working surface is different from the foam providing the second working surface.

4. A foam polishing pad according to claim 3 in which the foam providing the first working surface has a compressibility different from that of the foam providing the second working surface.

5. A foam polishing pad according to claim 3 which is formed by laminating two foam pads using an intermediate layer of a rubbery polymer.

6. A foam polishing pad according to claim 3 in which the rubbery intermediate layer is provided with a plurality of spaced recesses.

7. A polishing system adapted for use in conjunction with an orbital polisher which comprises:

a) a resiliently compressible foam polishing pad in the form of a disc comprising first and second opposed major working surfaces, each having a plurality of spaced depressions with the general shape of truncated hollow cones separated by truncated cones wherein the tops of the truncated cones all lie in the same plane and form the working surface; and b) a backup pad with which the foam polishing pad is retained in contact with one working surface projecting beyond the backup pad and the second working surface in contact with the backup pad; and c) retaining means for retaining one surface of the polishing pad in releasable contact with the backup pad.

8. A polishing system according to claim 7 in which the truncated ends forming the bases of the depressions and the tops of the truncated cones forming part of the working surface of the polishing pad are rounded.

9. A polishing system according to claim 7 in which the backup pad is in the form of a cup within which a portion of the polishing pad is retained said cup being provided with retaining means cooperating with recesses in the periphery of the polishing pad to limit rotational movement relative to the cup.

10. A polishing system according to claim 9 in which the base of the cup is provided with a shallow boss that contacts the working surface of the foam pad that lies within the cup.

11. A polishing system according to claim 9 that is adapted to be mounted to an orbital polisher.

12. A polishing system according to claim 9 in which the foam providing the first working surface of the pad has a compressibility different from that of the foam providing the second working surface of the pad.

13. A polishing system according to claim 9 in which the pad is formed by laminating two foam pads using an intermediate layer of a rubbery polymer.

14. A polishing system according to claim 9 in which the cup is provided with a plurality of ventilation holes.

15. A polishing system according to claim 7 in which the backup pad is in the form of a plate having an axial rod extension; the polishing pad has an axially located aperture adapted to accommodate the rod extension and having an area of greater diameter that the diameter of the rod adjacent each surface of the polishing pad; and the retaining means is releasably attached to the end of the rod so as to retain one surface of the polishing pad in contact with the backup plate.

16. A polishing system according to claim 15 which the backup pad is provided with a series of projections which penetrate the polishing pad to limit rotational movement of the polishing pad relative to the backup pad.

17. A polishing system according to claim 15 that is adapted to be mounted to an orbital polisher.

18. A polishing system according to claim 15 which the foam providing the first working surface of the pad has a compressibility different from that of the foam providing the second working surface of the pad.

19. A polishing system according to claim 15 which the pad is formed by laminating two foam pads using an intermediate layer of a rubbery polymer.

20. A polishing system according to claim 15 which the retaining means comprises a threaded member cooperating with a thread on the rod extension of the backup plate.

* * * * *